United States Patent [19]

Ishii et al.

[11] Patent Number: 4,517,432

[45] Date of Patent: May 14, 1985

[54] CAVITY ANTENNA MICROWAVE POWERED TURNTABLE

[75] Inventors: Thomas K. Ishii, Brown Deer, Wis.; Jorgen A. Jorgensen, Bloomington, Minn.

[73] Assignee: Northland Aluminum Products, Inc., Minneapolis, Mich.

[21] Appl. No.: 449,394

[22] Filed: Dec. 13, 1982

[51] Int. Cl.[3] ..... H05B 6/78

[52] U.S. Cl. ..... 219/10.55 F; 219/10.55 E

[58] Field of Search ..... 219/10.55 F, 10.55 E, 219/10.55 R

[56] References Cited

U.S. PATENT DOCUMENTS 4,219,715 8/1980 Mandle et al. ..... 219/10.55 E X 4,254,319 3/1981 Belt et al. ..... 219/10.55 F 4,258,630 3/1981 Jorgensen et al. ..... 219/10.55 F X

*Primary Examiner*—Philip H. Leung

*Attorney, Agent, or Firm*—Orrin M. Haugen; Douglas L. Tschida; Thomas J. Nikolai

[57] ABSTRACT

A portable turntable for use in microwave ovens which is used as a supporting base for a container of food which is cooked within the oven and adapted to gradually rotate the same, the apparatus including an electric motor which is mounted in and enclosed by a metal housing which housing has cavities tuned to capture the microwaves in the oven to power the turntable. The metal housing is enclosed by an outer enclosure of non-metallic material to prohibit electrical arcing between the metal portions and the oven walls.

29 Claims, 15 Drawing Figures

CAVITY ANTENNA MICROWAVE POWERED TURNTABLE

BACKGROUND OF THE INVENTION

It has long been recognized that the heating of food within an oven enclosure will be more uniform throughout the food product if it is rotated during the heating process. This is particularly desirable where the product is baked such as cakes, breads or the like.

Early recognition of this concept is found in U.S. Pat. No. 416,839 to Howard and U.S. Pat. No. 557,344 to Shaw.

With the advent of microwave cooking the principle involved became even more important due to the rapidity of baking or cooking the finished product. In microwave cooking the inner and outer portions of the product within the oven are both heated simultaneously and quickly to a normal cooking temperature. However, the microwave energies are not uniformly distributed within the oven enclosure resulting in unevenness in cooking throughout the body of the food product. It is accordingly even more desirable that the food product be slowly rotated during baking within a microwave oven. As the product is rotated the food passes through uneven microwave patterns to create an even cooking effect eliminating any so-called "hot spots" in the product mass. The "hot spots" are not in fixed locations but may shift over time and with varying "load" as different shapes and sizes of foods are cooked.

Accordingly others have invented structures specifically designed for microwave ovens. Examples are U.S. Pat. Nos. 2,632,838 to Schroeder and 3,177,335 to Fitzmayer et al, both of which show the use of turntables built into the microwave oven itself thus allowing the driving motor to be disposed outside of the oven interior and hence outside of the oven environment containing ultra-high frequency electromagnetic wave energy (hereinafter referred to as "microwave").

More recently, portable turntables for use in microwave ovens have been developed. An example is U.S. Pat. No. 4,258,630 to Jorgensen et al, which shows a portable turntable with all of the metal parts shielded within a relatively smooth metal enclosure where they are in an area of no microwave energy, such energy being excluded by the shielding so as to prevent arcing problems.

Additionally, a portable turntable powered by the microwave energy within a microwave oven is disclosed by U.S. Pat. No. 4,254,319 to Beh et al. This patent discloses a device wherein water is heated by the microwave energy to generate steam which powers a small turbine geared to drive the turntable. The exclusion of all metal from the structure makes it suited for the microwave oven environment. However, this structure is not suited to a practical turntable for a number of reasons. Heating the water consumes a good deal of power so that less power is available to cook the food resulting in increased cooking time. There is no steam power until the water is boiling so the turntable does not operate until then. When steam is produced it is produced rapidly for a fairly short period and is released into the oven where it may create problems. After the water has been consumed for production of steam, the water must be replaced for further operation.

A second microwave powered turntable is disclosed in U.S. Pat. No. 4,219,715 to Mandle et al, which discloses a structure driven by an electric motor and drive gearing. The motor is energized by electricity derived from the microwave energy in the oven. Loop antennae are disclosed sized to pick up microwave energy to be conducted to a suitable rectifier. However, deficiencies in the loop antennae and lack of a sufficiently powerful rectifier circuit result in insufficient power to drive an electric motor.

It is accordingly desirable that a turntable construction be provided in the way of a portable accessory powered by the microwave power within a microwave oven and utilizing improved antenna and rectifier structures.

SUMMARY OF THE INVENTION

A primary object of the present invention is to provide a self-enclosed and motorized turntable which may be energized and placed within an oven to serve as a base for a container of a food product cooked therein and gradually rotate the container during the cooking process.

Another object of the invention is to provide a portable rotary stand or turntable which may be used in microwave ovens with no arcing between the turntable drive mechanism and the oven.

Still another oject of the invention is to provide a portable rotary turntable for use in microwave ovens which may be energized by the microwave energy present within the cooking cavity of the microwave oven itself.

Yet another object of the invention is to provide a portable rotary turntable for use in microwave ovens which may generate ample power in relation to the load upon it to move varying loads at a fairly uniform rate of rotation.

A further object of the invention is to provide a microwave powered portable turntable employing a cavity antenna to provide efficient conversion of microwave energy to electrical power to operate the turntable.

Still a further object of the invention is to provide a microwave powered portable turntable employing a cavity antenna with a structure to protect the rectification diodes from overload and consequent failure when the turntable is within a microwave oven with very small or no food or liquid upon the turntable to absorb microwave energy.

With these and other objects in view the invention broadly comprises a portable rotary turntable having a base of microwave transmissive material, a turntable platform rotatably mounted to and covering the base, a motor housing of metallic material disposed within and secured to the base, a motor mounted within the housing, a cavity type antenna structure and circuitry within the motor housing to provide electric power to the motor derived from the microwave energy within a microwave oven, and drive means acting between the motor and cover whereby as the motor is energized the turntable platform will be rotated relative to the base.

DESCRIPTION OF THE PREFERRED EMBODIMENT

Figure 1:
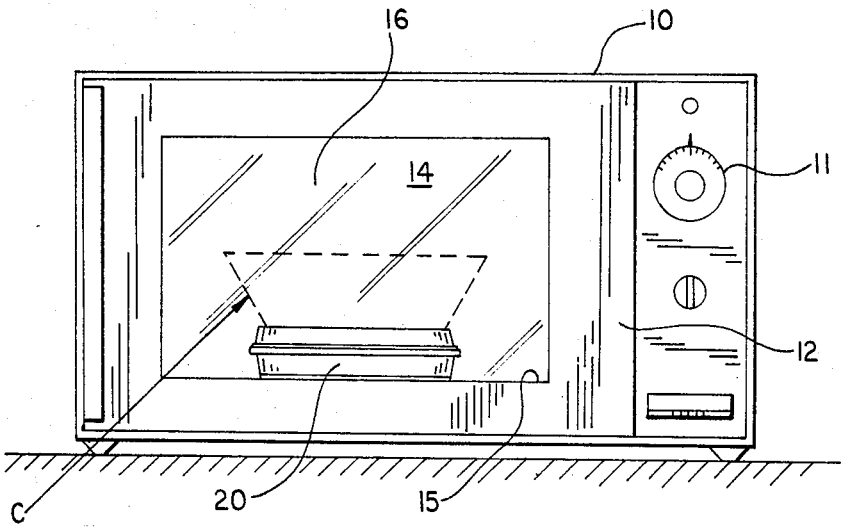
FIG. 1 is a front elevation of a conventional microwave oven with a transparent window in the front door showing the portable turntable positioned on the bottom or bottom shelf of the oven supporting a container for a food product being cooked in the oven.

Referring now more particularly to the drawings reference numerals will be used to denote like parts or structural features in the different views. The numeral 10 denotes generally a conventional microwave oven of boxlike configuration with controls 11, and hinged front door 12 having a transparent window 14 mounted therein. The bottom of the oven upon which the turntable unit rests is shown at 15 in FIG. 2 and a container C is shown positioned on the turntable within the oven in FIG. 1.

The turntable unit itself forming the subject of the present invention is designated generally by the numeral 20. It has a vertically shallow cylindrical overall shape and the construction thereof will best be understood by reference to FIGS. 2 and 4.

Figure 2:
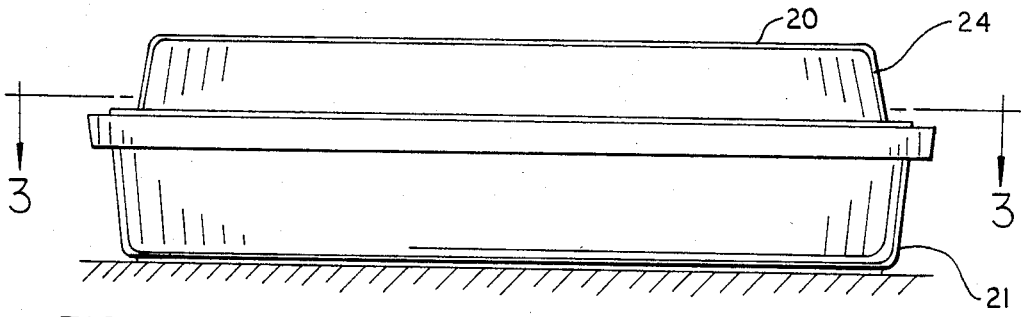
FIG. 2 is an enlarged side elevation of the turntable unit.

FIG. 2 shows the turntable 20 in side elevation with base 21 and rotatable turntable platform 24 in the form of a cover over base 21. Both the base 21 and platform 24 are formed of a material which is transparent to microwaves, having a low dielectric constant and having a low dissipation factor. This material will hereafter be referred to merely as "dielectric material."

Figure 4:
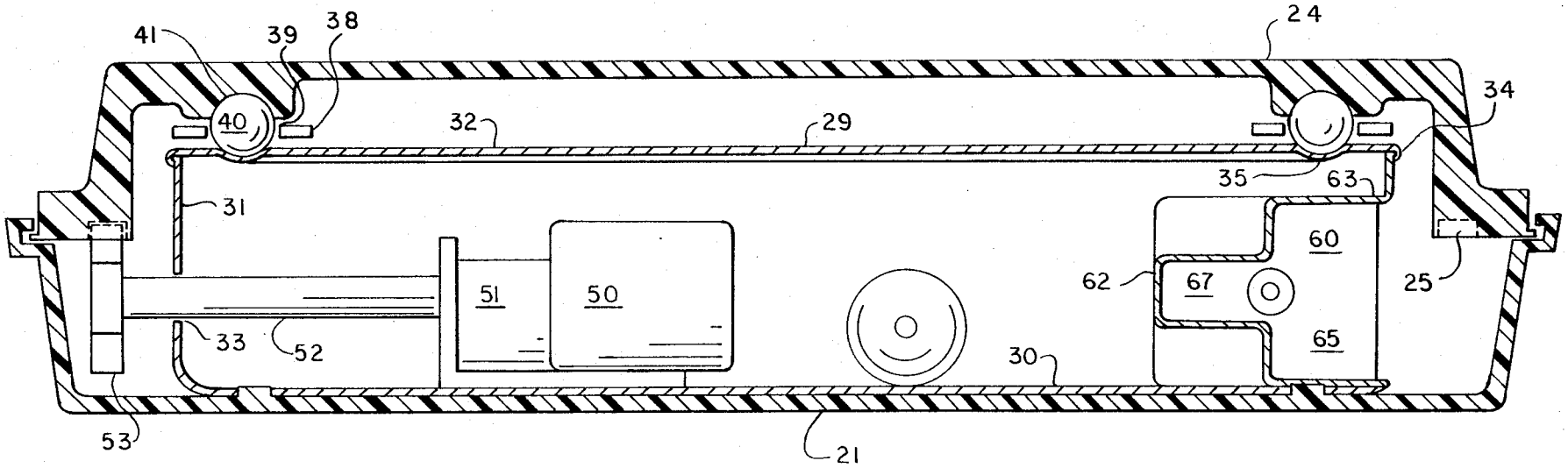
FIG. 4 is a vertical section through the turntable unit taken on line 4—4 of FIG. 3 but showing portions of the motor in elevation.

Referring now to FIG. 4, a motor housing 29 of metal material is located within base 21. This housing 29 is shown formed in two parts, a lower portion in the shape of an upwardly opening circular lower portion 30 and a cover 32 which completely covers the top of lower portion 30 with a turnover flange providing a secure interlock 34 between the lower portion 30 and cover 32. Alternatively, a crimped connection or screws or other fasteners could be used to secure the two pieces of housing 29 together. It is important that all exterior surfaces of housing 29 be smooth with no sharp projecting edges or points.

Housing cover 32 is provided with an annular upwardly opening raceway 35 which is concentric with the center of cover 32. Raceway 35 carries a plurality of ball bearings 40 which may freely roll therein or a plurality of cylindrical sliders 42 of a low friction material which may slide therein. The underside of platform 24 has an annular raceway 41 molded therein which opnes downwardly in vertically opening relation to raceway 35 in topwise engagement with the bearings 40 to sliders 42. Bearings 40 or sliders 42 are preferably formed of glass or other dielectric material and are disposed between the raceways 35 and 41.

The diameter of bearings 40 or sliders 42 is sufficient to support the platform 24 above the turntable base 21 in a slightly elevated position with respect to base 21. The numeral 38 denotes an annular roller case plate of dielectric material which has a series of apertures 39 spaced therearound for loosely receiving the ball bearings 40 and retaining them in spaced relation in the ball bearing embodiment.

Figure 3:
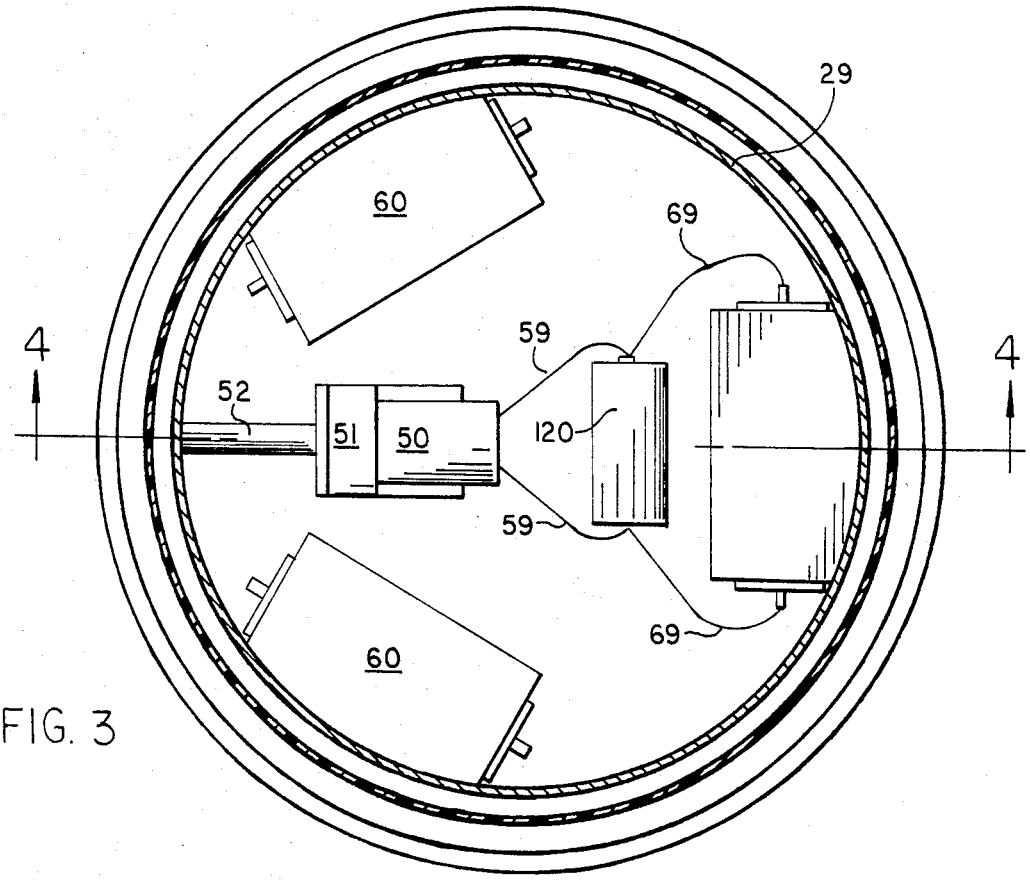
FIG. 3 is a horizontal section through the upper portion of the unit taken on line 3—3 of FIG. 2.
Figure 5:
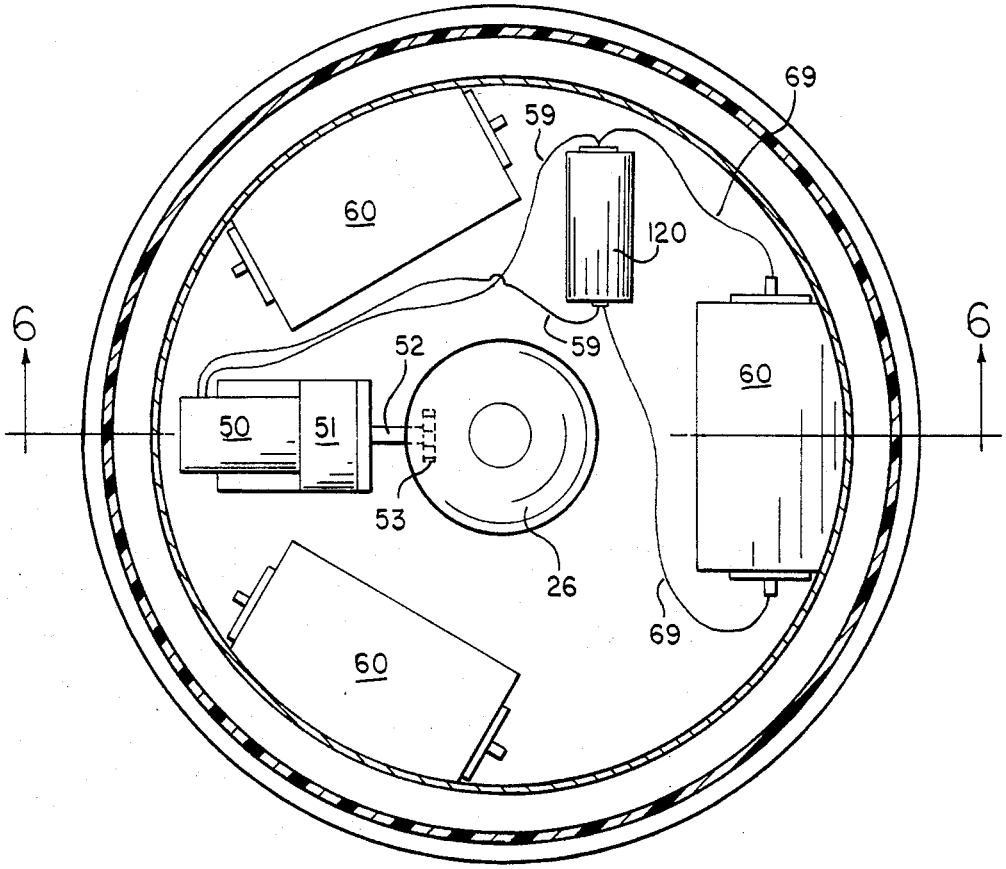
FIG. 5 is a horizontal section through the upper portion of the unit similar to that of FIG. 3 but showing a center drive rather than a rim drive.
Figure 6:
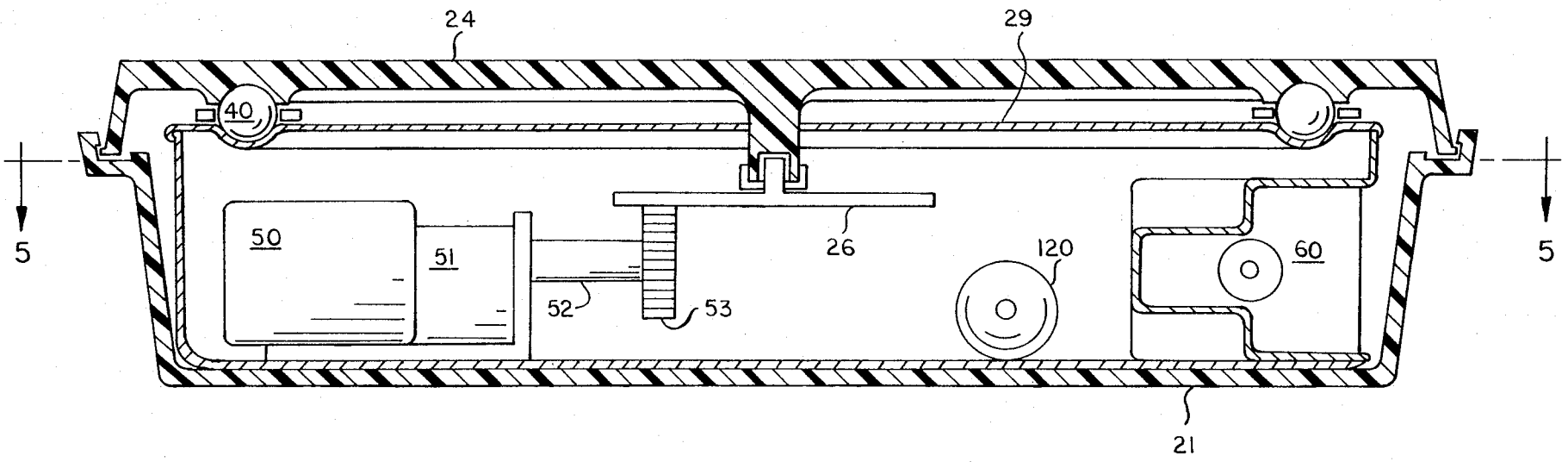
FIG. 6 is a vertical section through the turntable unit taken on line 6—6 of FIG. 5 showing a center drive and portions of the motor in elevation.

Referring now to FIG. 3, the lower portion 30 of motor housing 29 is shown within the turntable base 21. Mounted to lower portion 30 is motor 50 which is a low power electric motor. Attached to motor 50 is transmission means in the form of a gear reduction unit 51 with output shaft 52. This is shown in side section in FIG. 4 wherein it may be seen that output shaft 52 passes through an aperture 33 in side wall 31 of lower portion 30. Output shaft 52 is made of dielectric material and terminates in a pinion gear 53 which mates with a ring gear 25 formed in the periphery of the lower edge of platform 24 so that when motor 50 rotates output shaft 52, the rotatable platform 24 is driven to rotate also. In an alternate embodiment as shown in FIGS. 5 and 6, output shaft 52 does not pass through side wall 31 of lower portion 30 but is oriented so pinion gear 53 mates with a ring gear 26 formed in or mounted to the center of the underside of platform 24. Power for motor 50 is provided by collecting microwave energy from the microwave oven cavity and rectifying this energy to direct current. The random multimode microwave energy within the oven is not suited to rectification. This is overcome by providing a cavity type antenna which transforms the multimode energy in the microwave oven to a single mode which may be efficiently utilized to produce electrical energy.

Figure 7:
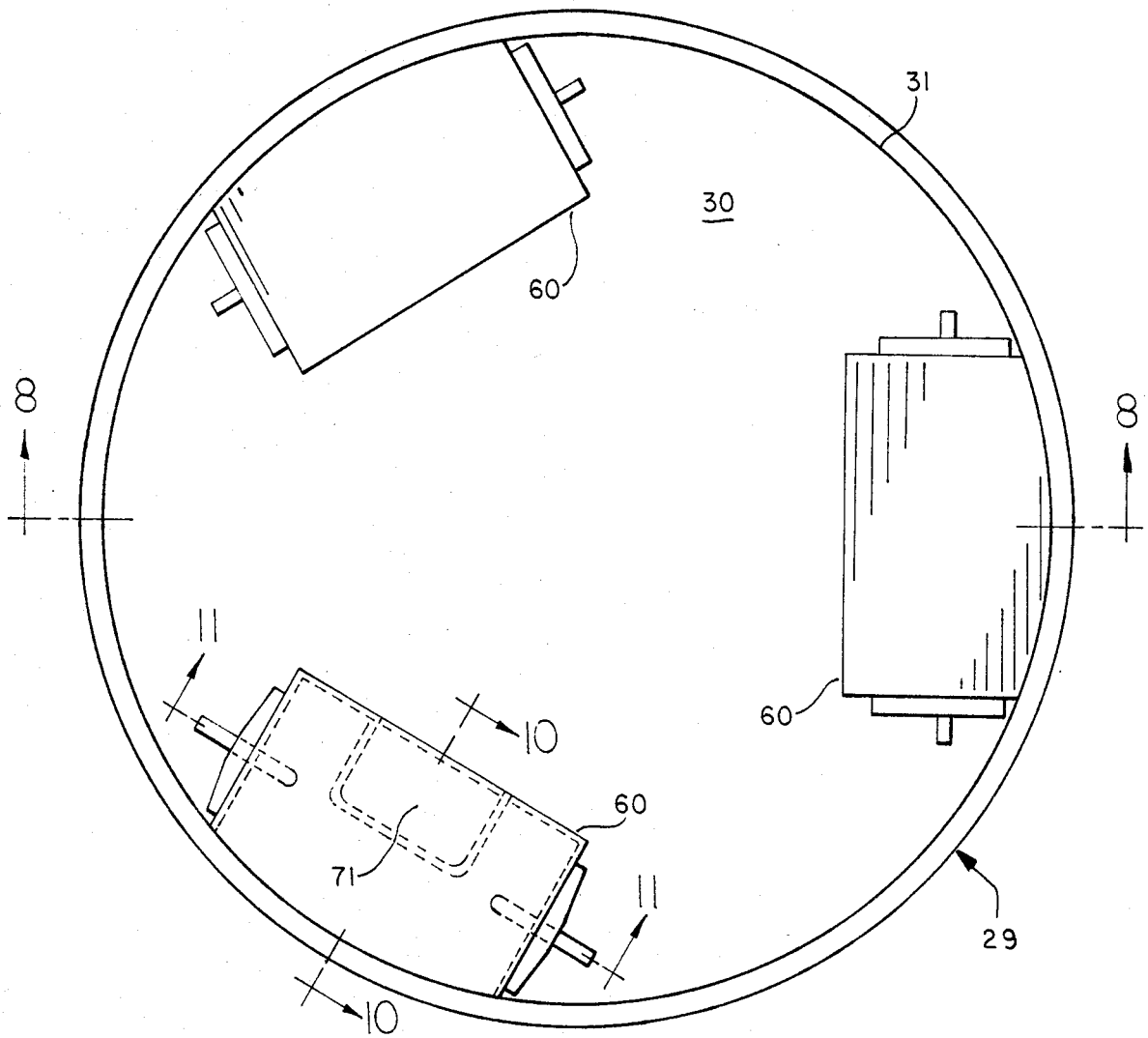
FIG. 7 is a horizontal section through the upper portion of the motor housing showing the antenna cavities in greater detail.
Figure 8:
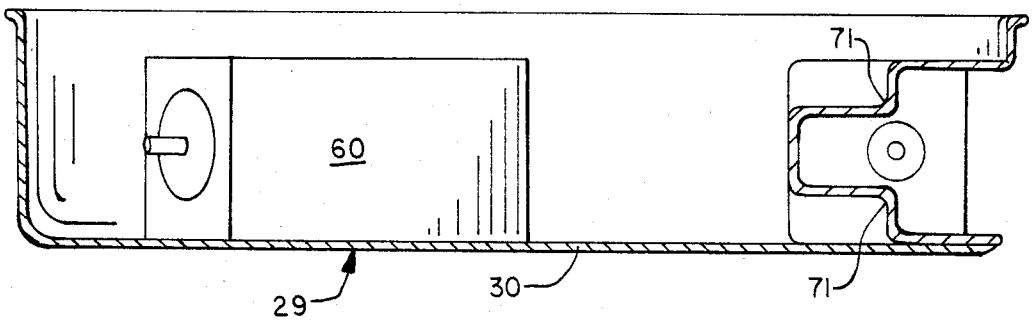
FIG. 8 is a vertical section through the motor housing taken on line 8—8 of FIG. 7.
Figure 9:
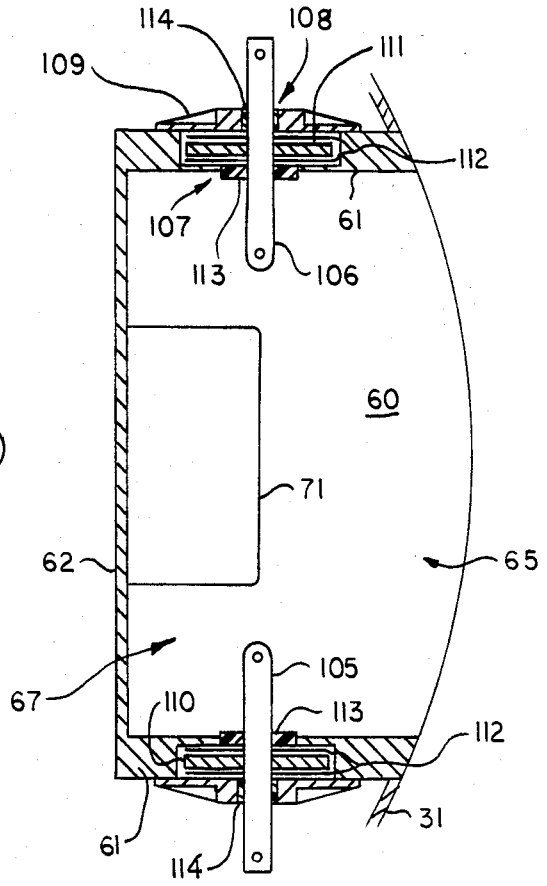
FIG. 9 is a horizontal section through an antenna cavity.
Figure 10:
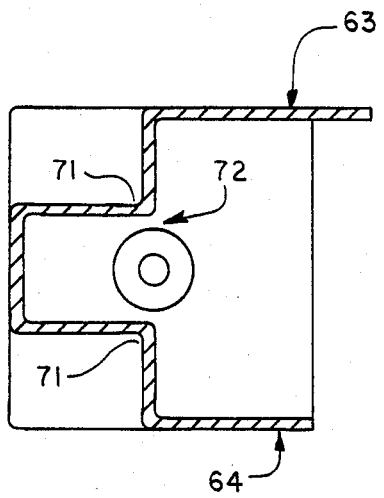
FIG. 10 is a vertical section through an antenna cavity taken on line 10—10 of FIG. 7.
Figure 11:
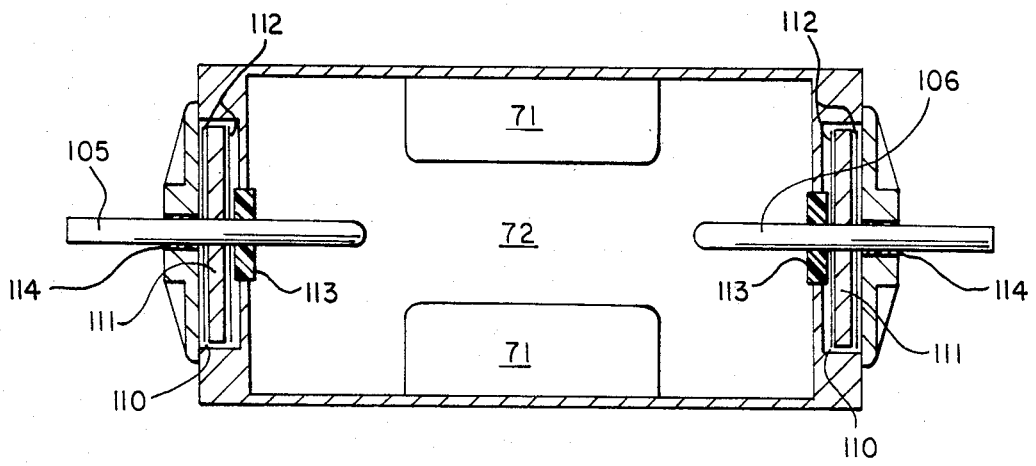
FIG. 11 is an enlarged side elevation of an antenna cavity.

Referring now to FIG. 7 and FIG. 8, the upwardly opening circular lower portion 30 of motor housing 29 is shown. The motor housing 29 is made of an electrically conductive metal and is shown with three cavities 60 formed in the lower portion side wall 31. Alternatively, the separately made cavities 60 may be fastened in openings in the lower portion side wall 31. In either case, though, these cavities 60 in the preferred embodiment are generally rectangular and are open at the side facing outwardly and enclosed on the other sides as well as at the top and bottom. A single cavity will function but it then becomes necessary to orient the turntable in the microwave oven so that the cavity is not in a dead spot. With multiple cavities the orientation is not a problem. FIG. 9 shows a cavity 60 in horizontal section. It may be seen that the housing side wall 31 stops at the cavity 60 and that the cavity side walls 61 and inner wall 62 connect with housing side wall 31 to form a continuous metal boundary to keep microwave energy out of the interior of housing 29, but allowing microwave energy to enter the cavity 60.

Figure 14:
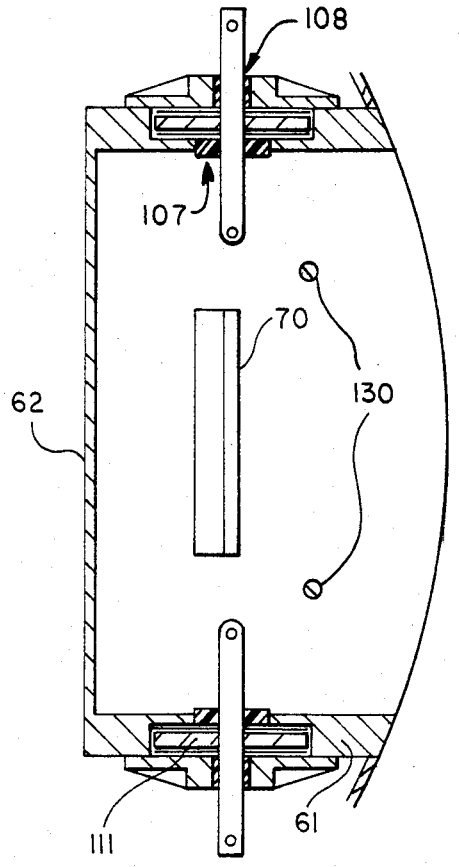
FIG. 14 is a view similar to that of FIG. 9 but showing an alternate embodiment.
Figure 15:
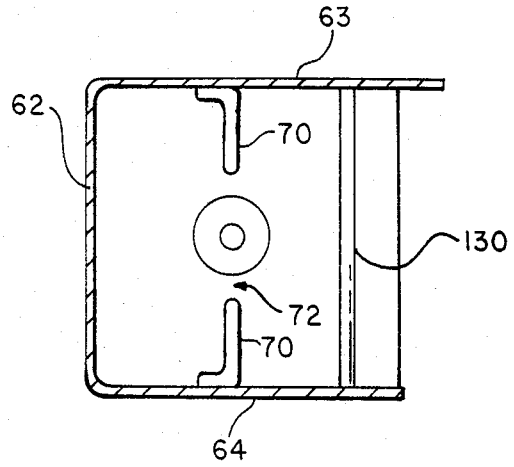
FIG. 15 is a view similar to that of FIG. 10 but showing an alternate embodiment.

The antenna cavity is of a predetermined size which is a fraction of the wavelength of the microwave energy employed in microwave ovens produced for commercial sale by industry. The industry standard is at or close to 2,450,000,000 cycles per second, more commonly written as 2,450 megahertz or 2,450 MHz. This corresponds to a free space wavelength of 12.24 centimeters or 4.82 inches. The cavity length measured from side to side at the opening of the cavity is the most critical dimension. It must be between 7 and 9 centimeters and better results are obtained from 7.8 to 8.2 centimeters with the best results at 8 centimeters or about 65/100 of the standard microwave wavelength. The least critical dimension is the cavity width measured from top to bottom of the opening. The width and length together give the size of the cavity opening or aperture. The cavity width may be between 1.8 and 3.2 centimeters with better results between 2.45 and 2.65 centimeters with the best results at a width of 2.55 centimeters. The cavity depth measured from the opening to the back wall is fairly critical and may be from 3 to 5 centimeters with better results at 3.8 to 4.2 centimeters and best results at 4 centimeters. The depth is measured at the sides of the cavity with a greater depth at the center due to the curvature of side wall 31 of lower portion 30 but the overhang at the center does not have much effect and may be discounted. Manufacturing considerations may dictate a cavity with a slight taper so that the cavity is wider at the opening than at the back wall 62. Tabs 70 shown in FIGS. 14 and 15 or ledges 71 shown in FIGS. 6 through 10, serve to form a constriction within a portion of the cavity. A vertical gap 72 of 1.18 centimeters or 0.464 inches between tabs 70 or ledges 71 produces good results in this usage as shall be explained.

Within the oven cavity 16 of a microwave oven 10 the microwave energy is fairly random or diffuse as to the direction of electrical and magnetic field vectors. Referring now to FIG. 9, the outer half of cavity 60 is in contact with this random oven microwave energy. This outer portion 65 acts as a wave guide transformer which is equivalent to a degenerated horn antenna and transforms the random energy entering cavity 60 to a single wave form or mode with the electrical vector of the microwave radiation oriented vertically and the magnetic vector of the microwave radiation oriented horizontally. This single standing wave has an electrical vector transverse to the largest cavity and is often referred to as the $TE_{10}$ mode. The inner half 67 of cavity 60 terminates at inner wall 62 and serves to reflect the wave to produce a resonance known as a standing wave in the single mode with a vertical electrical vector and a horizontal magnetic vector. The result is a strong standing wave in the cavity 60 with a vertical electrical vector.

Between the inner and outer halves of cavity 60 along the top wall 63 and bottom wall 64 are tabs 70 or ledges 71 which, as shown in FIG. 9, run across part of the width of the cavity and extend upwardly from the bottom 64 and downwardly from the top 63. Tabs 70 or ledges 71 serve to "pinch" the electrical vector in the region between these raised portions resulting in a greater voltage gradient in this region. The tabs may be located from 0.3 inch to 1.5 inch from inner wall 62 with a distance of 0.818 inch producing best results.

Figure 12:
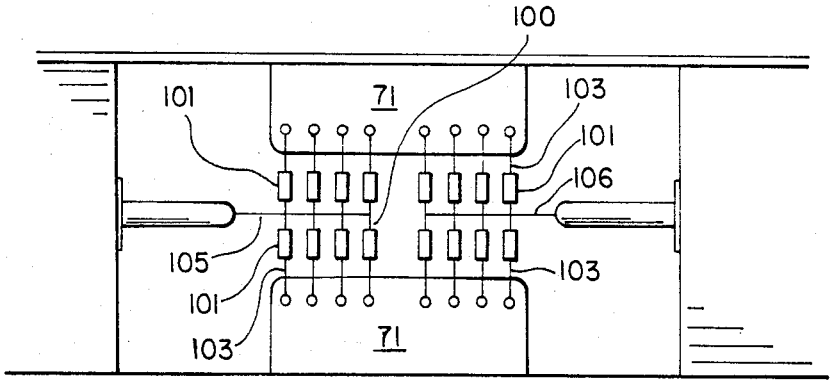
FIG. 12 is a similar view showing the placement of diodes in the cavity.
Figure 13:
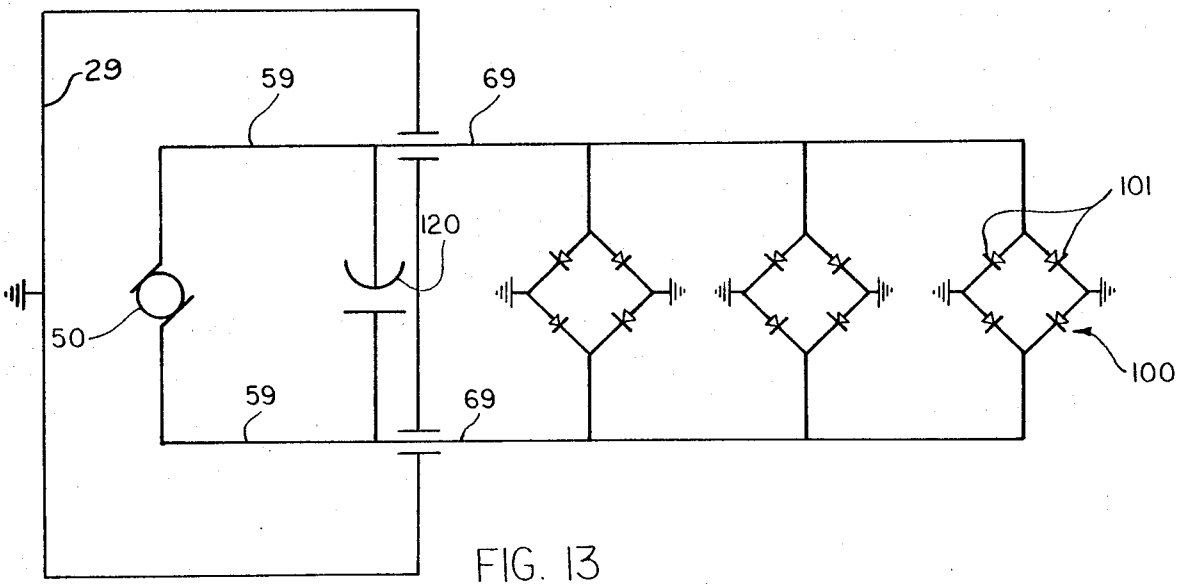
FIG. 13 is a circuit diagram showing the power circuit used to drive the turntable.

In this region of enhanced electrical field between the tabs 70 or ledges 71 is a diode array 100, as shown in FIG. 12, which serves as a full wave rectifier. All of the diodes and leads in this array lie within a plane or approximately so, so that the array is physically flat. All of the diodes in the array are oriented so that the diodes and leads are parallel and vertical. Connecting leads are horizontal and therefore at right angles or perpendicular to the diodes and diode leads. When placed into the cavity all of the diodes 101 in this array 100 are oriented vertically in the same direction as the electric field vector. The electric field vector, of course, is oscillating at 2,450 MHz so that it is alternately pointing upwardly and downwardly 2.45 billion times a second. This oscillating field vector induces an alternating current in the vertical diode leads 103 at the same frequency. The diodes 101 rectify this microwave alternating current to pulsating direct current which appears at array leads 105 and 106 which are polarized respectively negative and positive. Horizontal array leads 105 and 106 each pass through an opening 107 to a small cylindrical chamber 110 containing an electrically conducting metal disc 111 on the array leads which serves to remove any microwave frequency component and exclude its passage into the interior of the metal housing 29. This metal disc 111 within cylindrical chamber 110 is therefore a microwave bypass device. Metal disc 111 may have dielectric disc 112 on either side of it for electrical insulation. Likewise array leads 105 and 106 may have insulators about them in the form of dielectric bushings 113, shown in FIG. 9, in openings 107 facing the inside of the cavity 60 and dielectric bushings 114 in openings 108 facing the outside of the cavity 60. The dielectric discs and bushings prevent electrical arcing and allow use of a smaller separation than would be required with an air gap.

Only the rectified direct current and low frequency "ripples", typically 60 Hz or 120 Hz from the line current used to power the microwave oven 10, are passed through cylindrical chamber 110 and into the interior of metal housing 29. A filter capacitor 120 smoothes the "ripples" in the direct current to provide smoothed current which may directly drive electric motor 50. In the preferred embodiment, one or a pair of vertical conducting bars 130 is located toward the front and sides of the antenna cavity 60 so as to be parallel with the electric field vector of the standing wave present in the antenna cavity 60. This conducting bar or bars 130, preferably of metal, cause a slight mismatch or impedance within the antenna cavity 60. This has very minimal effect on the power developed at the motor leads so that there is little reduction of motor power developed. However, when there is a no load condition in the oven due to lack of a food product or liquid upon the turntable, the conducting bar or bars 130 do prevent overload and consequent failure of the array diodes 101. This diode protection structure is more cost effective, simpler and more durable than spark gaps, neon lamps, PIN diodes or Zener diodes which it replaces in array diode protection.

Three cavities equally spaced about housing 29 are shown. This is a preferred embodiment in that such a structure will have at least one cavity oriented so that adequate microwave energy is available to drive motor 50. A turntable could be constructed with only one cavity 60 and it would work if properly oriented, but this would not be as desirable as the present embodiment due to the uneven microwave energy density within commercial microwave ovens.

The diodes 101 employed must be of a type which can be operated at microwave frequencies and which will produce sufficient power. A suitable diode is available from Hewlett Packard Co., Palo Alto, Calif.

Four diodes 101 would form a full wave rectifier. Sixteen are employed in the present embodiment in each cavity to provide adequate power to drive motor 50. A diode with greater current capacity would permit use of four diodes in a full wave rectifier or even a single diode for half wave rectification should such a diode become available in the future.

No speed control is provided as motor 50 is sufficiently geared down that a suitable rate of turntable rotation is obtained with the motor 50 running under the load of gear reduction unit 51 with the food load producing very little variation.

The invention accordingly economically and effectively carries out the aforementioned objectives.

Having now therefore fully illustrated and described our invention, what we claim to be new and desire to protect by U.S. Letters Patent is:

1. A portable turntable for use in microwave ovens comprising:

(a) a base formed from a microwave transmissive material, (b) a turntable platform formed from a microwave transmissive material and situated above the base, (c) a housing fixedly mounted to the base, (d) a motor enclosed within the housing, (e) transmission means driven by the motor and connected to the platform for moving the platform relative to the base, (f) at least one cavity antenna for receiving microwave engergy defined by a plurality of electrically conductive walls and exposed to microwave energy via an opening through a side wall of the housing, (g) a rectifier situated at the focal point of a resultant electric field produced within the cavity antenna for coverting microwave energy to electrical energy usable by the motor, and (h) leads connecting the rectifier to the motor.

2. The turntable of claim 1 wherein the cavity antenna is three dimensionally rectangular and further comprises top and bottom walls having a first metal tab protruding downwardly from the top wall and a second metal tab protruding upwardly from the bottom wall so as to form a constriction in the cavity antenna between the tabs and having the rectifier mounted in the constriction between the tabs.

3. The turntable of claim 2 further comprising a metal bar positioned within the cavity antenna toward one side and connected at its ends to the top wall and bottom wall of the cavity.

4. The turntable of claim 3 wherein the metal housing further comprises an inside and an outside and having a continuous metal boundary between the inside and outside with the cavity antenna forming a part of the boundary and wherein the turntable further comprises a microwave bypass device where the leads enter from the cavity to the interior of the housing.

5. The turntable of claim 3 wherein the cavity antenna further comprises a back wall and the rectifier further comprises a full wave rectifier with diodes arranged in a planar array parallel with the back wall of the cavity.

6. The turntable of claim 5 wherein the turntable further comprises a filter capacitor within the metal housing across the leads to the motor.

7. The turntable of claim 5 wherein the microwave bypass device further comprises a shallow cylindrical chamber at each side of the cavity antennna communicating with the cavity antenna and the inside of the metal housing and having metal discs within the cylindrical chambers which discs are in contact with the leads from the rectifier to the motor.

8. The turntable of claim 5 wherein the cavity antenna length smaller than 9 centimeters and greater than 7 centimeters, a width smaller than 3.5 centimeters and greater than 1.5 centimeters and a depth greater than 3 centimeters and smaller than 5 centimeters.

9. The turntable of claim 8 wherein the tabs are located less than 1.5 inches and more than 0.3 inches from the inner wall of the cavity antenna.

10. The turntable of claim 5 wherein the cavity antenna has a length of 8 centimeters, a width of 2.55 centimeters and a depth of 4 centimeters.

11. The turntable of claim 10 wherein the tabs are located 0.818 inches from the inner wall of the cavity antenna.

12. The turntable of claim 1 wherein the dimension of said cavity antenna orthogonal to the produced electric field is at least one-half the wave length of the received microwave signal.

13. The turntable of claim 1 wherein said cavity antenna includes a wave guide portion adjacent said opening and a resonant portion adjacent said wave guide portion for producing a single mode standing wave.

14. The turntable of claim 1 wherein said cavity antenna produces a single mode standing wave and relative to the electric field of which wave said rectifier is situated in predetermined relation.

15. The turntable of claim 1 wherein said rectifier comprises a full wave rectifier and which is centrally mounted in said cavity antenna.

16. A portable turntable for use in microwave ovens comprising:

(a) a base formed from a microwave transmissive material, (b) a turntable platform formed from a microwave transmissive material and situated above the base, (c) an electrically conductive housing fixedly mounted to the base, (d) a motor enclosed within the housing, (e) transmission means driven by the motor and connected to the platform for moving the platform relative to the base, (f) a cavity defined by a plurality of walls and exposed to microwave energy via an opening through a side wall of the housing and wherein a first and a second wall have respective first and second electrically conductive tabs protruding inwardly therefrom so as to form a constriction in the cavity between the tabs, (g) a rectifier situated within the cavity and mounted in the constriction between the tabs for converting microwave energy to electrical energy usable by the motor, and (h) leads connecting the rectifier to the motor.

17. The turntable of claim 16 further comprising a metal bar positioned within the cavity toward one side and connected at its ends to said first wall and said second wall of the cavity.

18. The turntable of claim 17 wherein the conductive housing further comprises an inside and an outside and having a continuous metal boundary between the inside and outside with the cavity forming a part of the boundary and wherein the turntable further comprises a microwave bypass device where the leads enter from the cavity to the interior of the housing.

19. The turntable of claim 17 wherein the cavity further comprises a back wall and the rectifier further comprises a full wave rectifier with diodes arranged in a planar array parallel with the back wall of the cavity.

20. The turntable of claim 19 wherein the turntable further comprises a filter capacitor within the metal housing across the leads to the motor.

21. The turntable of claim 19 wherein the microwave bypass device further comprises a shallow cylindrical chamber at each side of the cavity communicating with the cavity and the inside of the housing and having metal discs within the cylindrical chambers which discs are in contact with the leads from the rectifier to the motor.

22. The turntable of claim 19 wherein the cavity has a length smaller than 9 centimeters and greater than 7 centimeters, a width smaller than 3.5 centimeters and greater than 1.5 centimeters and a depth greater than 3 centimeters and smaller than 5 centimeters.

23. The turntable of claim 22 wherein the tabs are located less than 1.5 inches and more than 0.3 inches from the inner wall of the cavity.

24. The turntable of claim 19 wherein the cavity has a length of 8 centimeters, a width of 2.55 centimeters and a depth of 4 centimeters.

25. The turntable of claim 24 wherein the tabs are located 0.818 inches from the inner wall of the cavity.

26. A portable turntable for use in microwave ovens comprising:

(a) a base formed from a microwave transmissive material, (b) a turntable platform formed from a microwave transmissive material and situated above the base, (c) an electrically conductive housing having a plurality of walls and fixedly mounted to the base and including a plurality of concave cavities extending inwardly of the walls of said housing, each of said cavities further including a region of constriction, (d) a motor enclosed within the housing, (e) transmission means driven by the motor and connected to the platform for moving the platform relative to the base, (f) a rectifier situated within each cavity and mounted in the region of constriction for converting microwave energy to electrical energy usable by the motor, and (g) lead means for connecting each rectifier to the motor.

27. The turntable of claim 26 wherein each of said rectifiers comprises a full wave rectifier having a planar array of diodes and wherein said diode array is positioned in each region of constriction in alignment with an electric field vector of the microwave energy.

28. The turntable of claim 26 wherein said lead means comprises a plurality of pairs of first and second elongated electrically conductive members, said first and second members of each pair extending in opposed relation to each other through the walls of one of said cavities in centered relation to the region of constriction and each of said first and second members at each cavity wall including an electrically conductive third member in electrical contact therewith and said first, second and third members being separated from the cavity walls via a plurality of dielectric members.

29. The turntable of claim 26 wherein each cavity is formed as an integral part of said housing.

* * * * *